US008505570B2

(12) United States Patent
Wimmer

(10) Patent No.: US 8,505,570 B2
(45) Date of Patent: Aug. 13, 2013

(54) MOBILE CRANE WITH HOSE GUIDE

(75) Inventor: Eckhard Wimmer, Hallein (AT)

(73) Assignee: Palfinger AG, Bergheim (AT)

( * ) Notice: Subject to any disclaimer, the term of this patent is extended or adjusted under 35 U.S.C. 154(b) by 345 days.

(21) Appl. No.: 12/984,785

(22) Filed: Jan. 5, 2011

(65) Prior Publication Data

US 2011/0132862 A1 Jun. 9, 2011

Related U.S. Application Data

(63) Continuation of application No. PCT/AT2009/000269, filed on Jul. 9, 2009.

(30) Foreign Application Priority Data

Jul. 11, 2008 (AT) ..... A 1089/2008

(51) Int. Cl.
*A62C 35/00* (2006.01)

(52) U.S. Cl.
USPC ..... 137/355.17; 137/377; 137/615; 74/608; 74/609; 74/612

(58) Field of Classification Search
USPC ..... 137/615, 377, 355.16, 355.17, 355.24; 212/347–350, 177, 299; 52/117, 220.3, 573.1; 92/128; 37/403, 466, 468; 138/110, 106, 138/112; 74/608, 609, 612–616
See application file for complete search history.

(56) References Cited

U.S. PATENT DOCUMENTS

| | | | | |
|---|---|---|---|---|
| 3,332,434 | A * | 7/1967 | Stahmer | 137/355.17 |
| 3,872,881 | A | 3/1975 | Miller et al. | |
| 3,885,816 | A | 5/1975 | Miller et al. | |
| T974001 | I4 * | 9/1978 | Neal | 137/377 |
| 4,156,436 | A * | 5/1979 | Hawk | 137/355.17 |
| 4,265,063 | A * | 5/1981 | Muller | 137/377 |
| 4,304,077 | A | 12/1981 | Muller | |

(Continued)

FOREIGN PATENT DOCUMENTS

| | | |
|---|---|---|
| DE | 40 07 470 | 3/1991 |
| EP | 1 580 159 | 9/2005 |

(Continued)

OTHER PUBLICATIONS

Austrian Search Report issued Mar. 13, 2009 in A 1089/2008.

(Continued)

*Primary Examiner* — Craig Schneider
*Assistant Examiner* — Craig J Price
(74) *Attorney, Agent, or Firm* — Wenderoth, Lind & Ponack, L.L.P.

(57) ABSTRACT

A mobile crane has at least two crane booms which are connected together by a joint such that the angular position with respect to each other can be adjusted. At least one hose between the crane booms, and the hose is exposed in the region of the joint in at least one angular position of the crane booms. At least one flexurally elastic sheet is connected with the at least one hose or covers it at least in the exposed region and can flex when the angular position of the at least two crane booms is changed. The at least one flexurally elastic sheet can be moved into or respectively out of one of the crane booms upon a change in the angular position of the crane booms.

10 Claims, 15 Drawing Sheets

(56) References Cited

U.S. PATENT DOCUMENTS

| | | | | |
|---|---|---|---|---|
| 4,861,112 | A * | 8/1989 | Grant | 137/355.24 |
| 5,806,313 | A | 9/1998 | Koshi et al. | |
| 6,930,244 | B1 | 8/2005 | Nebel | |
| 7,784,259 | B2 * | 8/2010 | O'Rourke et al. | 138/110 |
| 7,849,928 | B2 * | 12/2010 | Collie | 138/112 |

FOREIGN PATENT DOCUMENTS

| | | | |
|---|---|---|---|
| FR | 2 499 051 | | 8/1982 |
| GB | 2096568 | A * | 10/1982 |
| JP | 10-280474 | | 10/1998 |
| JP | 2002-266374 | | 9/2002 |

OTHER PUBLICATIONS

Chinese Search Report issued Oct. 16, 2012 in Chinese Patent Application No. 200980126486.0.

* cited by examiner

MOBILE CRANE WITH HOSE GUIDE

This application is a continuation application of International application PCT/AT2009/000269, filed Jul. 9, 2009, the entire disclosure of which is incorporated herein by reference.

BACKGROUND OF THE INVENTION

The present invention relates to a mobile crane having at least two crane booms which are connected together by a joint such that the angular position with respect to each other can be adjusted, and having at least one hose passing between the crane booms. The hose is exposed in the region of the joint in at least one angular position of the crane booms.

A mobile crane of that type is disclosed in EP 1 580 159 B1. As accurately stated in paragraph 2 of that document, such mobile cranes have at least one first crane boom in the form of a crane pillar and a second crane boom in the form of a hoist boom. The crane pillar is normally mounted on a support frame which is fastened to the vehicle chassis. The crane pillar is rotatably mounted about a vertical axis with respect to the support frame. The hoist boom is mounted via the joint connecting the two crane booms such that the angular position about a horizontal axis can be adjusted. Most cranes additionally have a further crane boom which is mounted on the hoist boom via a joint such that the angular position can be adjusted (about a horizontal axis) which is usually termed the jointed boom. A jib can also be mounted in the jointed boom; this latter may have a plurality of jib extensions.

The angular adjustment of the at least two crane booms is usually carried out via hydraulically driven piston cylinder mechanisms the hydraulics of which employ a plurality of hoses which have to be guided through the mobile crane. The various possible types of hose guides are described in detail in paragraph 2 of EP 1 580 159 B1 and thus do not need to be reiterated here.

In order to prevent uncontrolled bulges or loops of the hoses from being formed in the region of the joint, which in extreme cases could result in damage to the hoses, EP 1 580 159 B1 discloses an approximately U-shaped hose guide arranged in the region of the joint which can be aligned by means of a separate hydraulic adjustment mechanism with a changed angular position of the crane booms connected via the joint.

The problem with that device is that it is relatively difficult to install because of the range movement of the crane arms. In addition, in order to be adjusted to a different angular position of the crane booms, the U-shaped hose guide must be carried separately.

U.S. Pat. No. 5,806,313 discloses a hose guide arrangement consisting of a flexible material that is fixed between two pins, with one pin on each of the two crane booms. If the angular position of the two crane booms changes with respect to each other, the flexible hose guide arrangement is stretched or compressed in order to accommodate the changed distance between the two pins.

The problem with that construction is that it is relatively bulky, since relatively long pins are required which thus project out a long distance from the crane boom so that the flexible hose guide arrangement can be placed under sufficient tension.

SUMMARY OF THE INVENTION

The aim of the invention is to provide a mobile crane of the above type in which pinching of the at least one hose due to an angular displacement of the two crane booms towards each other is prevented, and the device provided for this purpose is of particularly simple construction and of low bulk.

Using at least one flexurally elastic sheet is advantageous since its inherent stiffness, the basis of its flexural elasticity, means that it does not require a specific tensioning device. Further, no specific adjustment mechanism is required in order to compensate for a change in the angular position of the two crane booms with respect to each other since, because of its flexural elasticity, the at least one sheet flexes when the angular position of the two crane booms is changed and thus it adjusts by itself. The invention can be used over a wide range of movement of the crane booms.

In the context of the present invention, the term "at least two crane booms which are connected together via a joint the angular position of which can be adjusted" may mean the crane pillar and the hoist boom on the one hand and also the hoist boom and the jointed boom on the other hand.

Further advantageous embodiments are defined in the dependent claims.

In general, a single hose is rarely employed in practice; usually, a plurality of hoses is employed which are connected with the at least one flexurally elastic sheet (in order to produce a hose bundle) or is covered by it in at least in the exposed region.

The invention is of particular application in securing the hoses interconnecting the hoist arm and jointed boom. Concerning the attachment of the jointed boom to the hoist boom, two different systems are known in the art. In one system, the connecting bracket is on the outside of the hoist boom and the bush is inside the jointed boom. In the other system, the bushes are coupled inside the hoist boom and the bracket is on the outside of the jointed boom.

Particularly preferred embodiments of the invention will now be described for each of the two systems, but the invention is not limited to application in the respectively described system, but can be used in other systems (if necessary with modifications which are familiar to the skilled person). The invention is also, in general, not limited to being employed in the two systems discussed.

The thickness of the flexurally elastic sheet is between 0.3 mm and 3 mm.

If the bush is coupled in the jointed boom and the bracket is on the outside of the hoist boom (first system), then, for example, exactly one flexurally elastic sheet may be provided which, for example, is in the form of a spring steel sheet (preferably an approximately 0.4 mm thick, laminated Nirospring steel sheet). The sheet can be fastened under the hose cuffs of the hoist boom and over the hose cuffs of the jointed booms. Here, at the highest point of the maximum flexing radius with the hyperextended jointed boom (approximately in the center of the sheet), a cuff may be provided for the at least one hose through which the at least one hose can slide. The cuff may, for example, be produced from plastic and be fastened to the sheet. Thus, the differing flexing radii of the at least one hose and the flexurally elastic sheet can be accommodated.

If the bushes are coupled in the hoist boom and the bracket is on the outside of the jointed boom (second system) then, for example, two flexurally elastic sheets may be provided and the at least one hose passes between the sheets.

The two sheets may, for example, be formed from 2 mm thick polyethylene sheets. The two sheets may be fastened to the jointed boom above and below the hose cuffs. One of the two sheets (preferably the one closest to the pivot point) has holes in the central and rear region. The other sheet (furthest from the pivot point) is slightly longer and in this region has slots so that their different flexing radii can be accommodated. The two sheets may be clamped together via these holes by means of fastening means (for example bolts) and spacers (preferably in the form of strips), for example plastic strips. The head of the bolt may be countersunk in the strips on the outside, to prevent them from scraping on the hoist boom bushes. The bolts may be fixed on the underside using Seeger rings. Particularly preferably, the fastening means are short in the center in order to clamp the at least one hose (in practice the hose bundle) correctly. The fastening device for the back row may be slightly longer in order to ensure that the at least one hose can be slipped out for replacement. If the at least one hose has to be changed, the Seeger rings of the accessible central spacers can be opened. This allows the at least one hose along with its fitting to be pulled through the rear spacer.

As will be seen in the accompanying figures in particular, in the transport position of the mobile crane the two flexurally elastic sheets may lie close together, flush against the at least one hose. In the preferred embodiment, during operation of the crane (i.e. not in the transport position) the at least one hose (or hose bundle) can be pushed into the hoist boom thereby reliably avoiding pinching of the at least one hose between the hoist boom and jointed boom.

Both of the systems discussed above negate the possibility of the at least one hose being crushed. Above all, when the at least one flexurally elastic sheet is imperforate, then the at least one hose is also protected from external influences such as UV radiation, or gritting salt during transport and the like.

Over the entire range of movement of the jointed boom, for example 180° (transport position) to −15° (hyper extended working position), the flexurally elastic sheet(s) can flex over the at least one hose which then cannot be pinched between the hoist boom and the jointed boom.

The application is not limited to hydraulic hose applications. As an example, the invention could also be employed in protecting hoses through which electrical conductors pass.

The flexural elasticity of the at least one sheet means that, in all embodiments of the invention, the contour of the sheet and the contour of the at least one hose match in all of the angular positions of the crane booms.

BRIEF DESCRIPTION OF THE DRAWINGS

Further advantages and details of the invention will become apparent from the figures and the accompanying drawings, in which.

Since mobile cranes are known in the art (see, for example, EP 1 580 159 B1 discussed above), only those details of the mobile crane which serve to illustrate the invention are shown.

DETAILED DESCRIPTION OF THE INVENTION

Figure 1A:
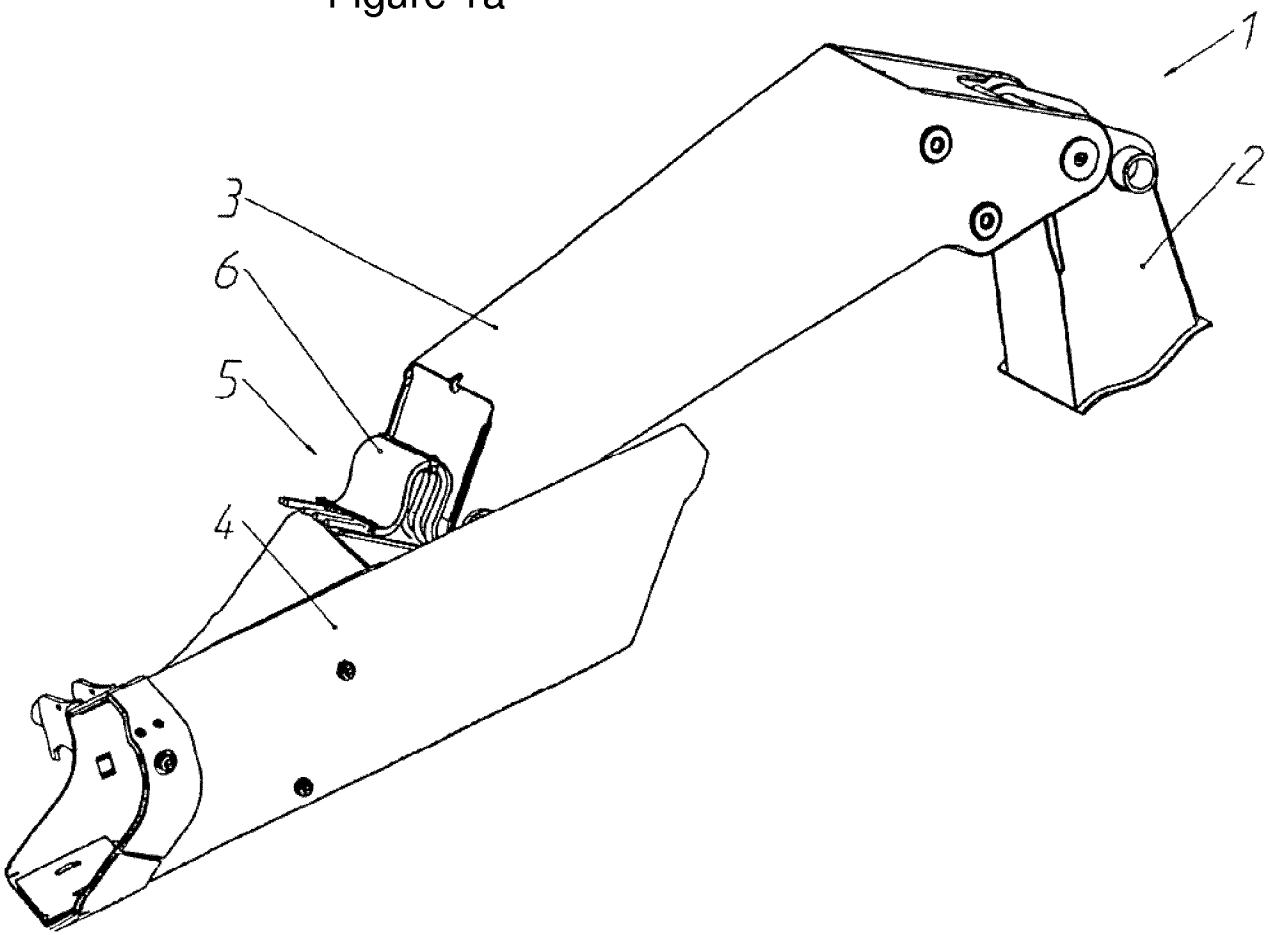
FIGS. 1 to 3 show the invention applied to the first system for fastening of the jointed boom to the hoist boom.

FIG. 1*a* shows a perspective view of various parts of a mobile crane 1 with a crane pillar 2, only part of which is shown, a hoist boom 3 and a jointed boom 4. The crane pillar 2 is fixed to a plate (not shown) which can be mounted on a support frame (on a vehicle, also not shown) so that the crane pillar 2 is rotatably mounted about a vertical axis. The terms "vertical" and "horizontal" are employed on the assumption that the vehicle chassis is horizontal.

The crane pillar 2 can turn about a vertical axis of the support frame, which is not shown. The hoist boom 3 is rotatable about a horizontal axis with respect to the crane pillar 2. Similarly, the jointed boom 4 is rotatably mounted about a horizontal axis on the hoist boom 3. A jib, not shown, may be arranged in the jointed boom 4, possibly together with jib extensions.

The angular position of the hoist boom 3 and jointed boom 4 is adjusted by piston cylinder units, not shown, so that there is a need in the embodiment shown for several hydraulic hoses to be guided from the hoist boom 3 to the jointed boom 4. As can be seen in FIG. 1*a*, the hydraulic hoses are exposed in the region of the joint between the hoist boom 3 and jointed boom 4. In the illustrated embodiment of the invention, a flexurally elastic sheet 6 is used to form a hose bundle 5.

Figure 1B:
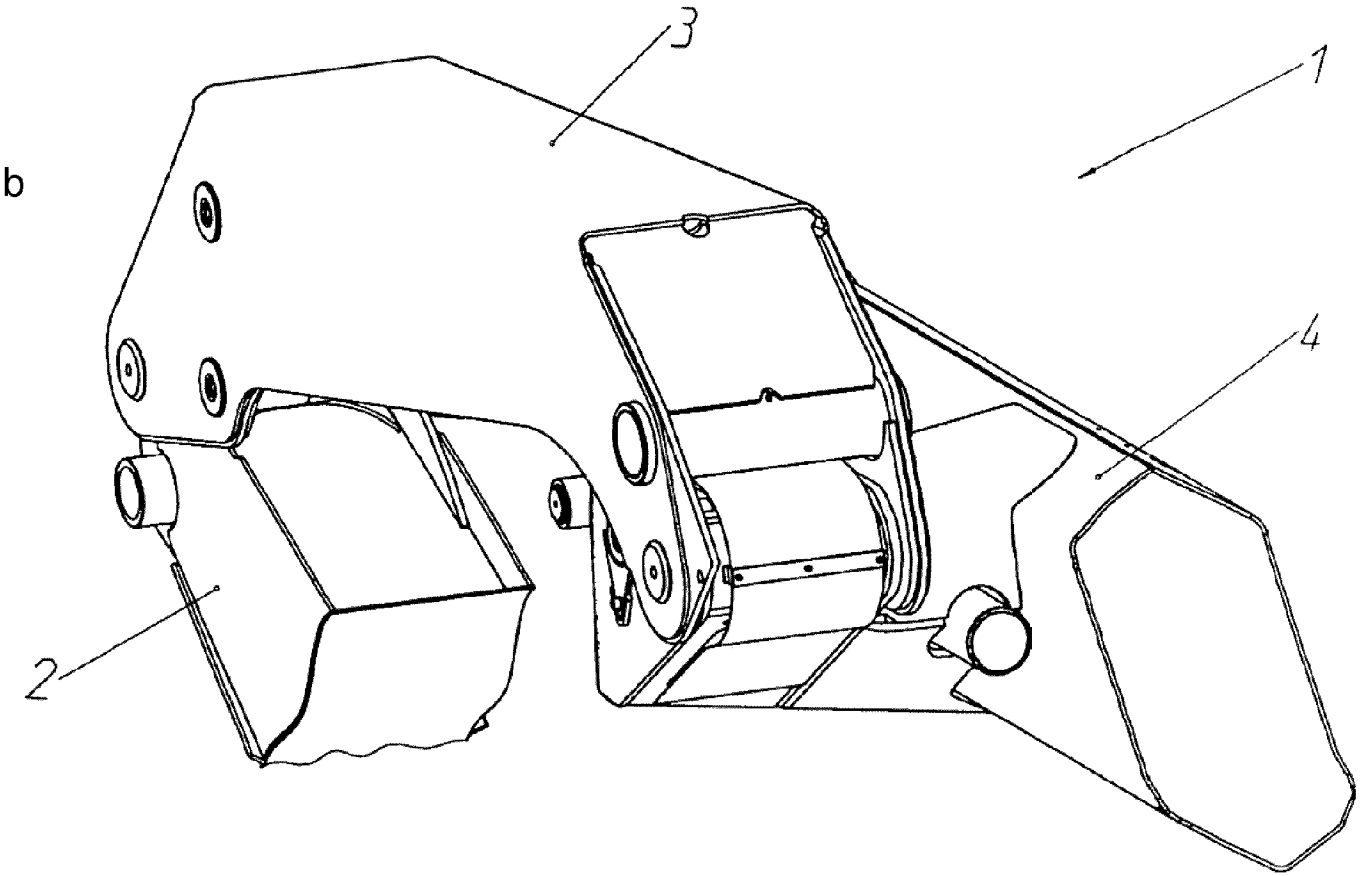

Since the full length of the hydraulic hoses is required in the transport position of the mobile crane 1 shown in FIG. 1*b* and a shorter length of the hydraulic hoses is required in the working position shown in FIG. 1*a*, depending on the angular position of the crane booms 3, 4, the hydraulic hoses might have to bulge out. Because the hydraulic hoses are connected to the flexurally elastic sheet 6, which in turn is flexed by a change in the angular position of the crane booms 3, 4, bulging of the hydraulic hoses occurs in a controlled manner, preventing pinching of the hydraulic hoses in the region of the joints.

Figure 2A:
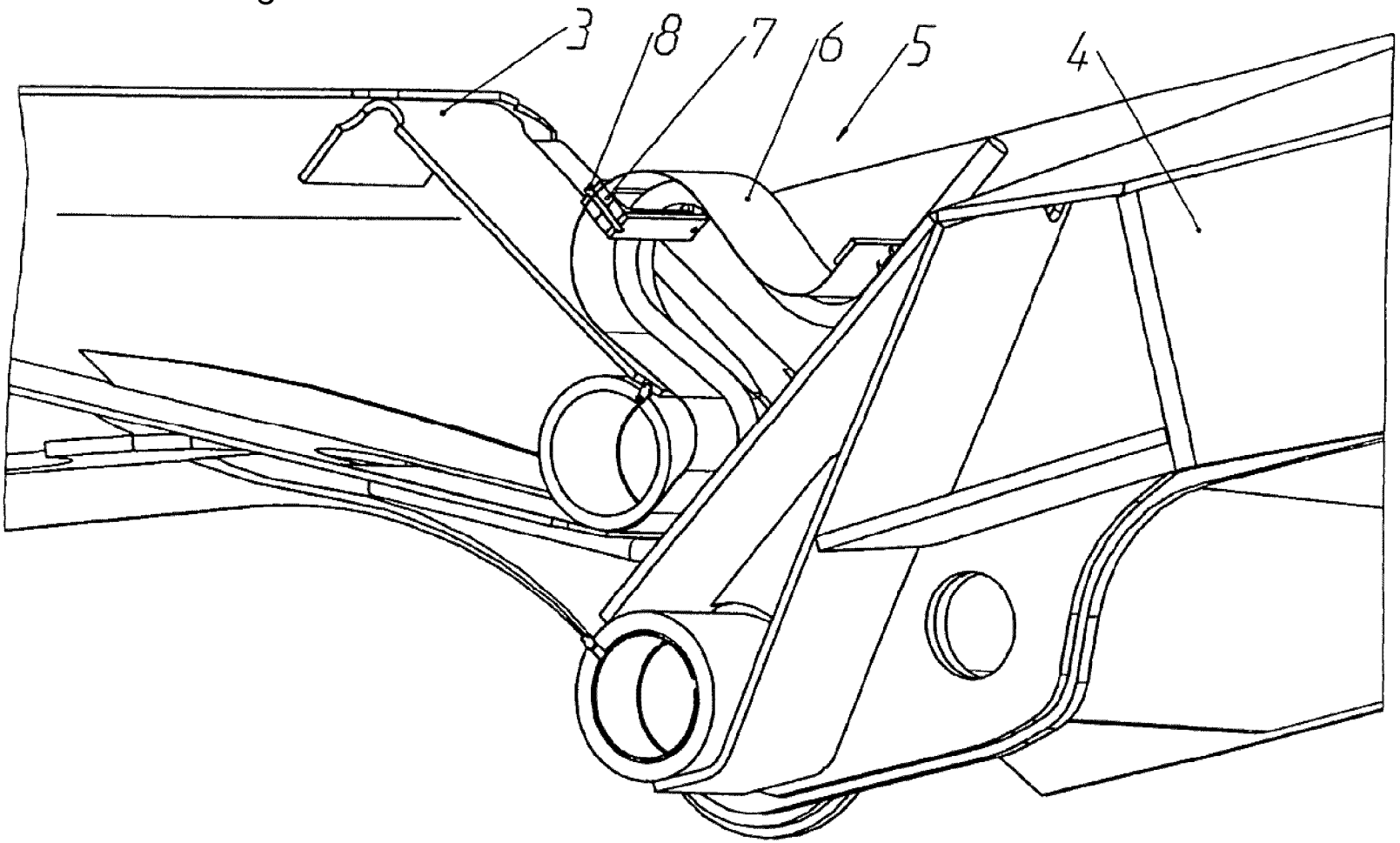
Figure 2B:
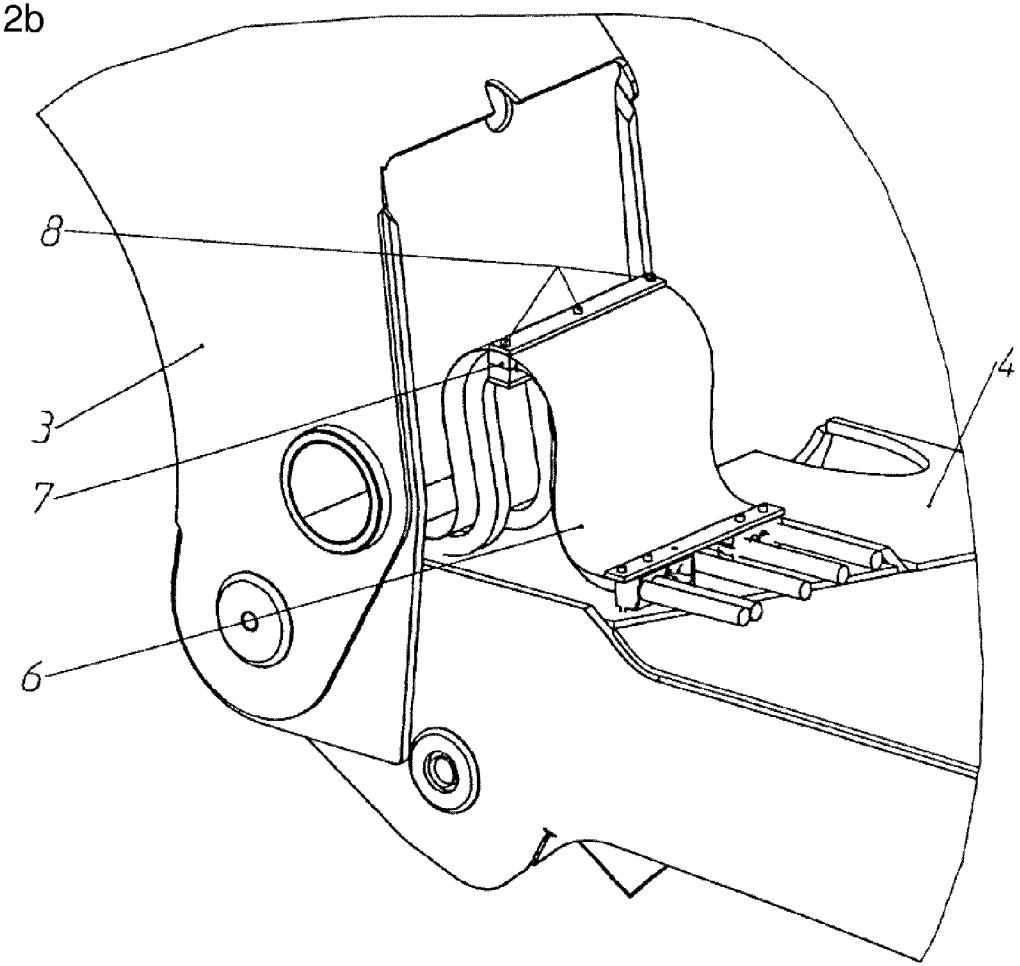
Figure 2C:
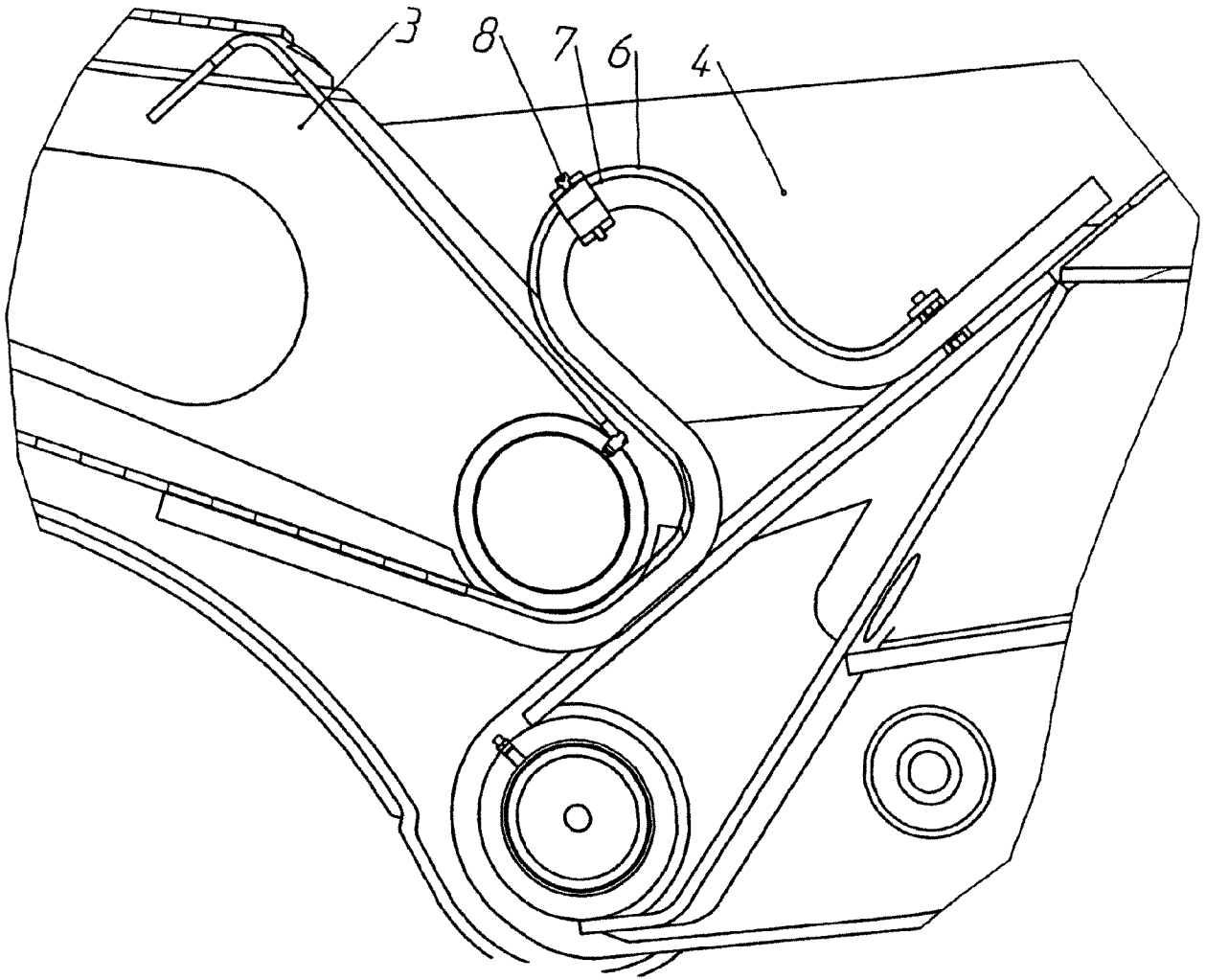

FIGS. 2*a* to 2*c* show different views to FIG. 1*a* with particular attention paid to the representation of the hose bundle 5.

FIG. 2*c* in particular shows that the hydraulic hoses in this embodiment are flush against the flexurally elastic sheet 6 and do not simply follow the contours thereof at a certain distance therefrom.

One end of the flexurally elastic sheet 6 is fastened to the hoist boom 3 and the other end is fastened to the jointed boom 4. Approximately in the center of the flexurally elastic sheet 6 (at the highest point of the maximum flexing radius in the hyperextended jointed boom 4), a cuff 7 is fastened to the flexurally elastic sheet 6 by fastening device 8. The hydraulic hoses can slide through this cuff 7, thereby ensuring that the differing flexing radii of the hydraulic hoses and the flexurally elastic sheet 6 as the angular position of the crane booms 3, 4 changes can be accommodated.

It should be noted that FIGS. 2*a* to 2*c* show differing numbers of hydraulic hoses. This is to illustrate the fact that the invention is not limited to a specific number of hydraulic hoses. In general, the invention is, naturally, not limited to hydraulic hoses, but also can be used with other types of hoses which are exposed between crane booms. In a manner that differs from that shown, the flexurally elastic sheet 6 may also be arranged under the hydraulic hoses, i.e. between the hydraulic hoses and the crane booms 3, 4.

Figure 3:
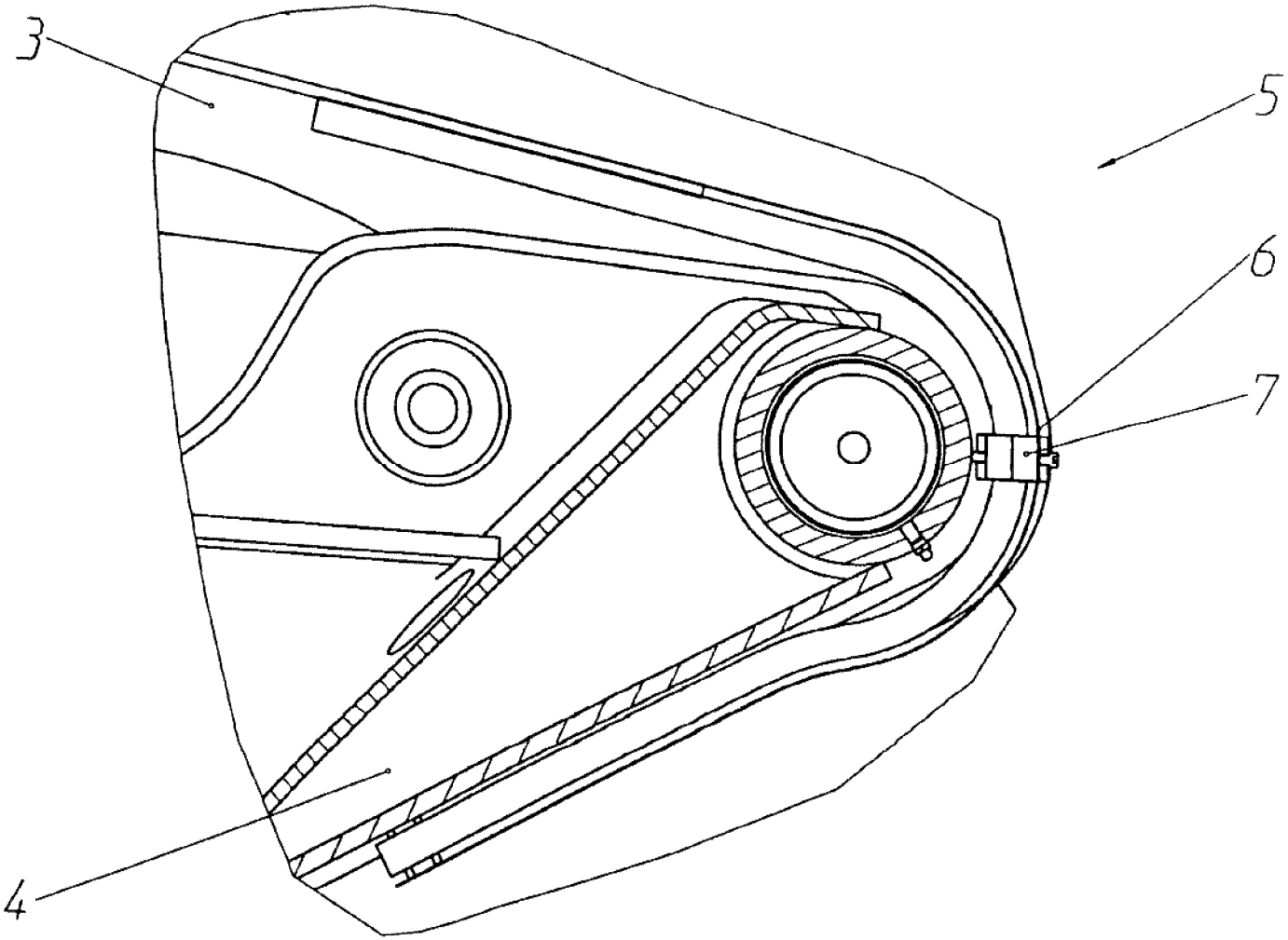

FIG. 3 shows a sectional view in the region of the joint, wherein the crane booms 3, 4 are in the transport position of the mobile crane 1.

Figure 4A:
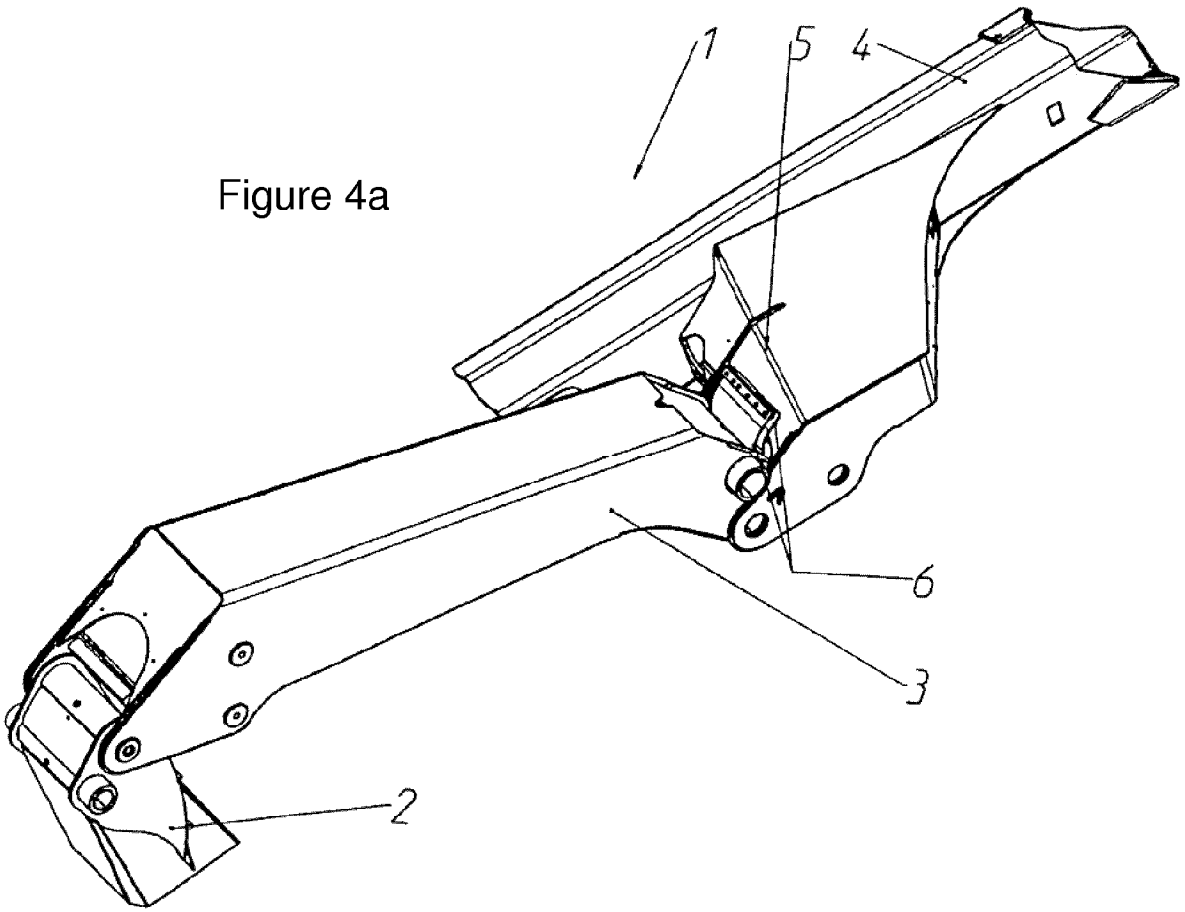
FIGS. 4 to 6 show the invention applied to the second system.
Figure 4B:
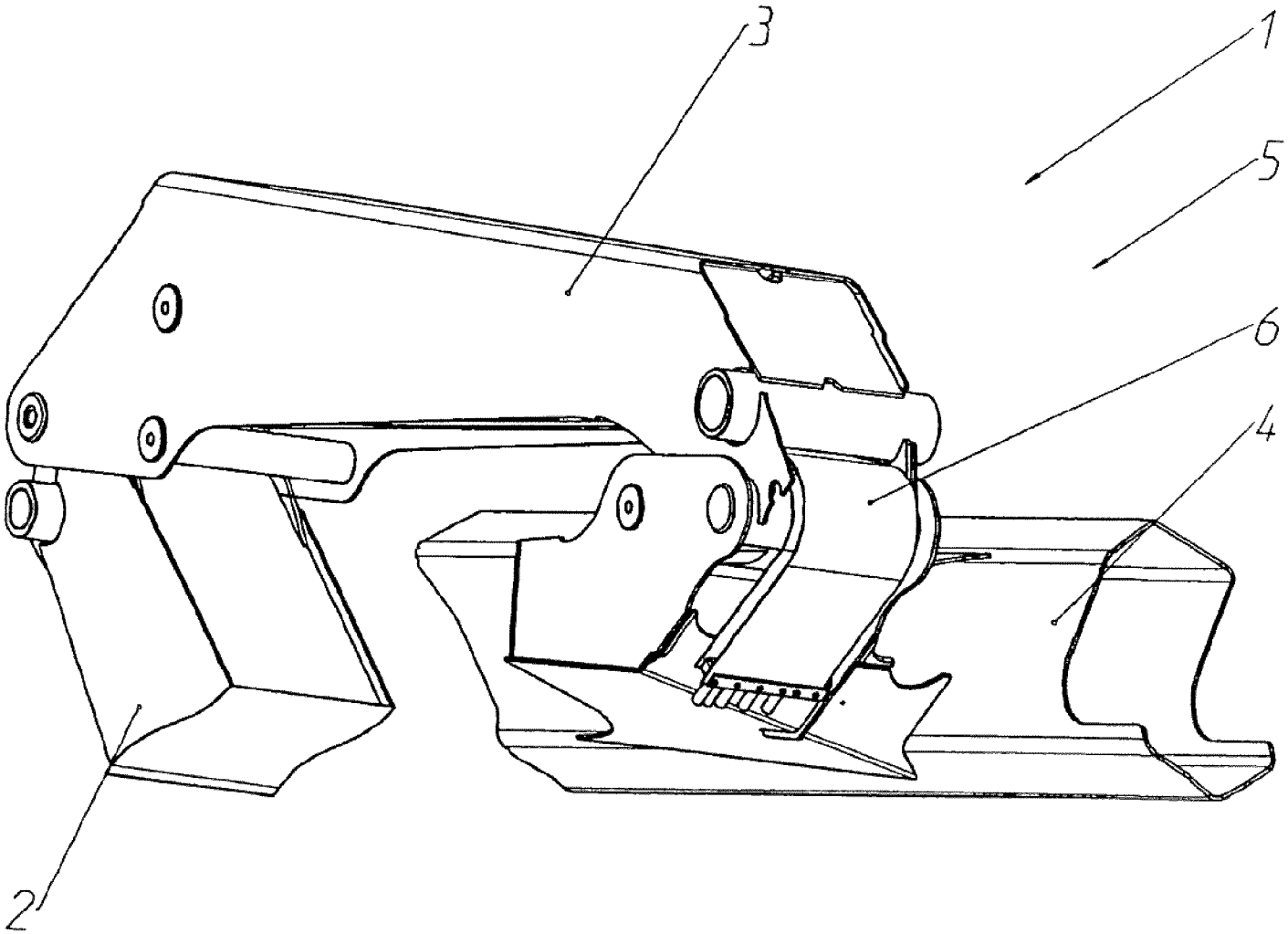
Figure 4C:
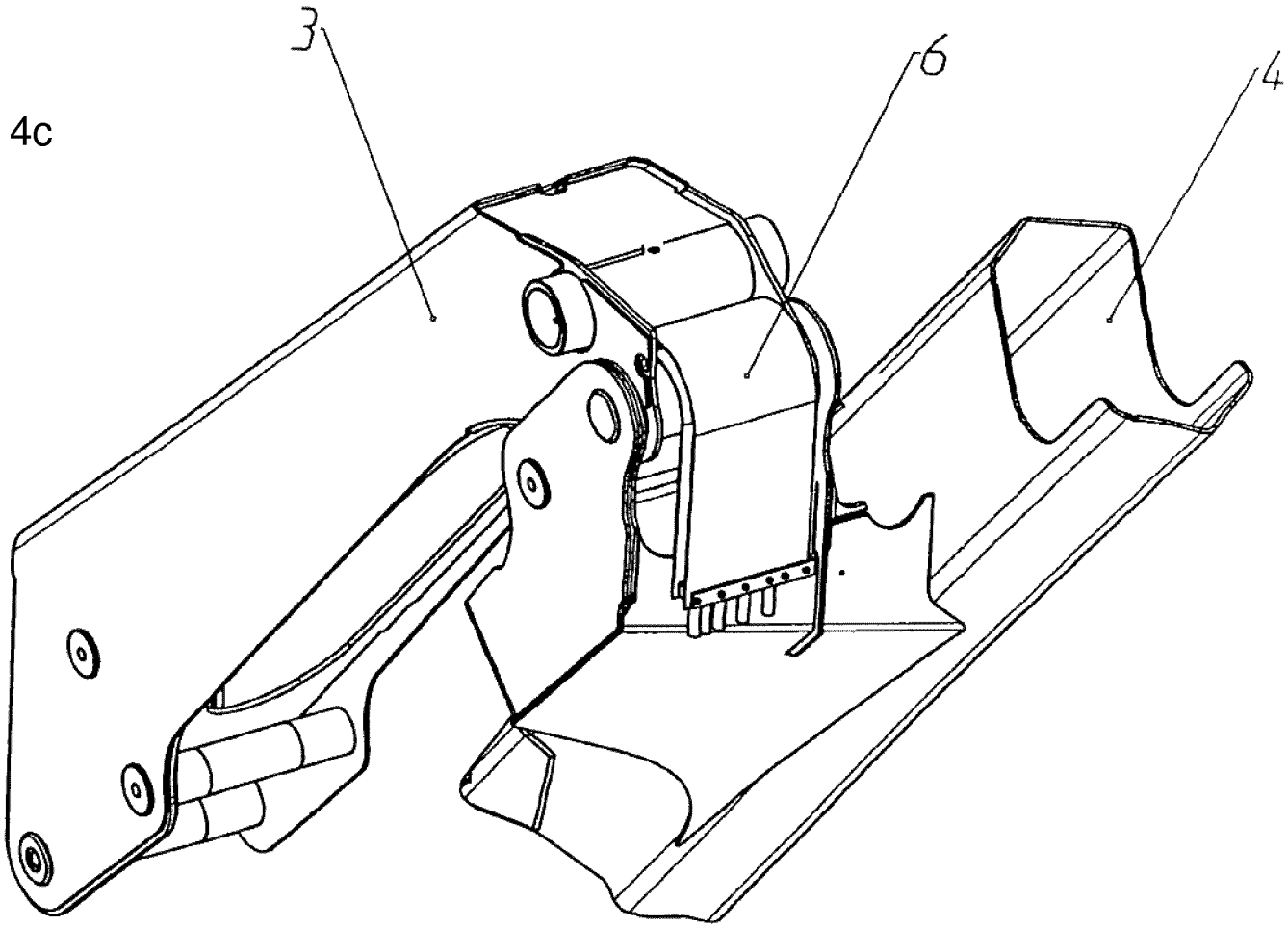
Figure 4D:
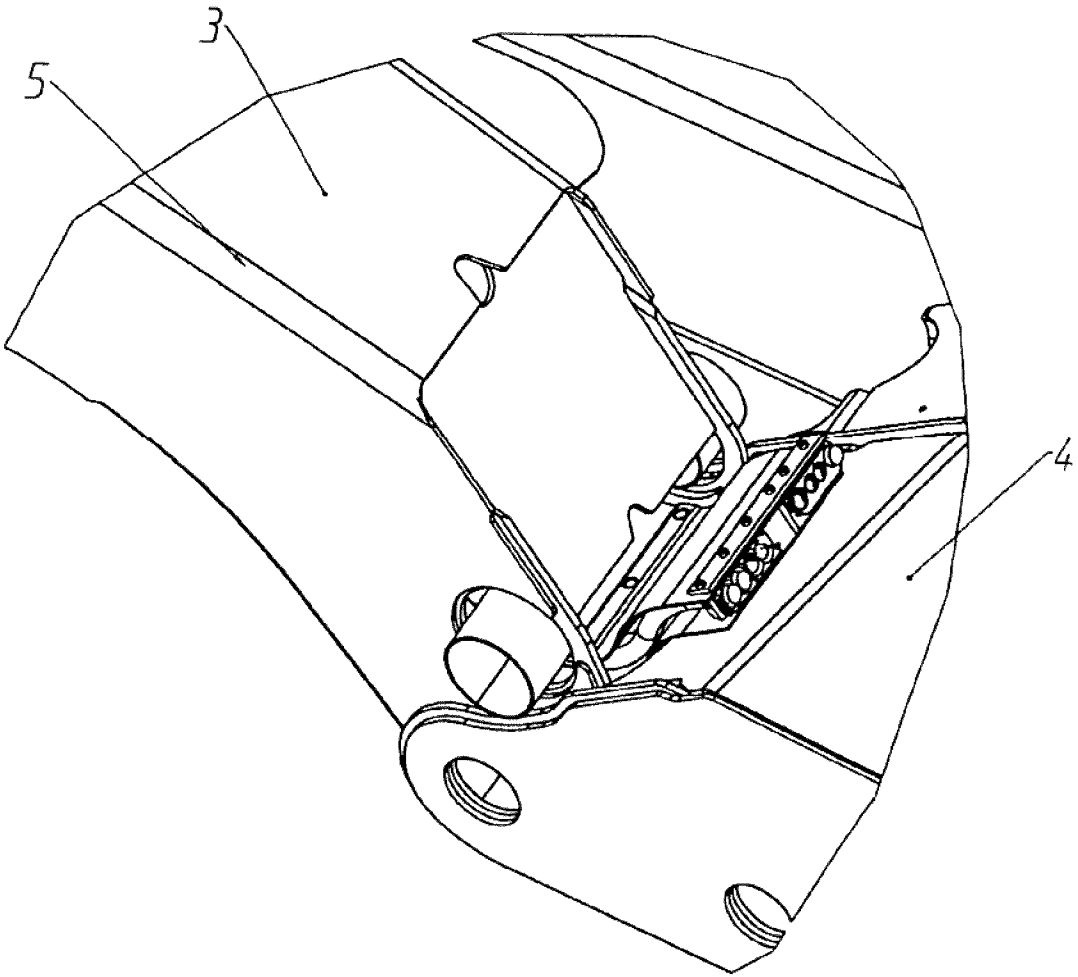
Figure 5A:
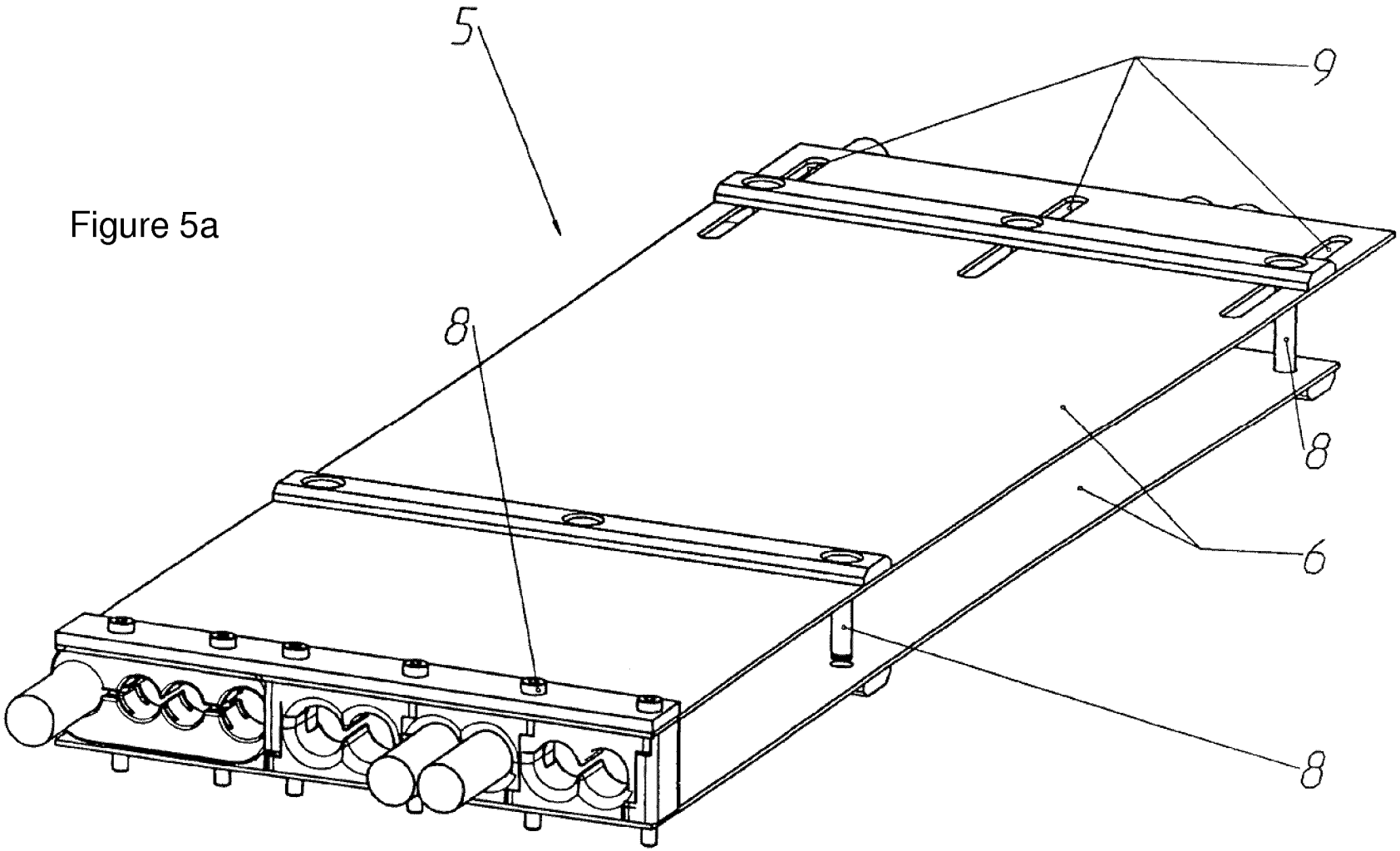

FIG. 4*a* shows a perspective view corresponding to FIG. 1*a* for the second system for fastening the jointed boom 4 to the hoist boom 3. The mobile crane 1 is thus again in a working position. FIGS. 4*b* and 4*c* show the corresponding position of the crane booms 3, 4 in the transport position of the mobile crane 1. Again, FIG. 4*d* shows a more detailed view than FIG. 4*a*; it will be seen that the entire hose bundle 5 is pushed at least partially into the hoist boom 3 in the working position. The hose bundle 5 is shown in more detail in FIGS. 5*a* and 5*b*. FIG. 5*a* shows that in the present case two flexurally elastic sheets 6 are employed, which are connected together via fastening device 8. The hydraulic hoses pass between the two flexurally elastic sheets 6, thereby protecting both their upper side and their underside in the region of the joint. FIG. 5*a* shows that the fastening device 8, arranged approximately in the center of the flexurally elastic sheet 6, are somewhat shorter than the fastening device 8 on the right hand end of the flexurally elastic sheet 6 shown in FIG. 5*a*. Therefore, the two flexurally elastic sheets 6 are separated by a smaller distance in their center region than at their end regions This allows the hydraulic hoses to be slipped out for exchange purposes.

Figure 5B:
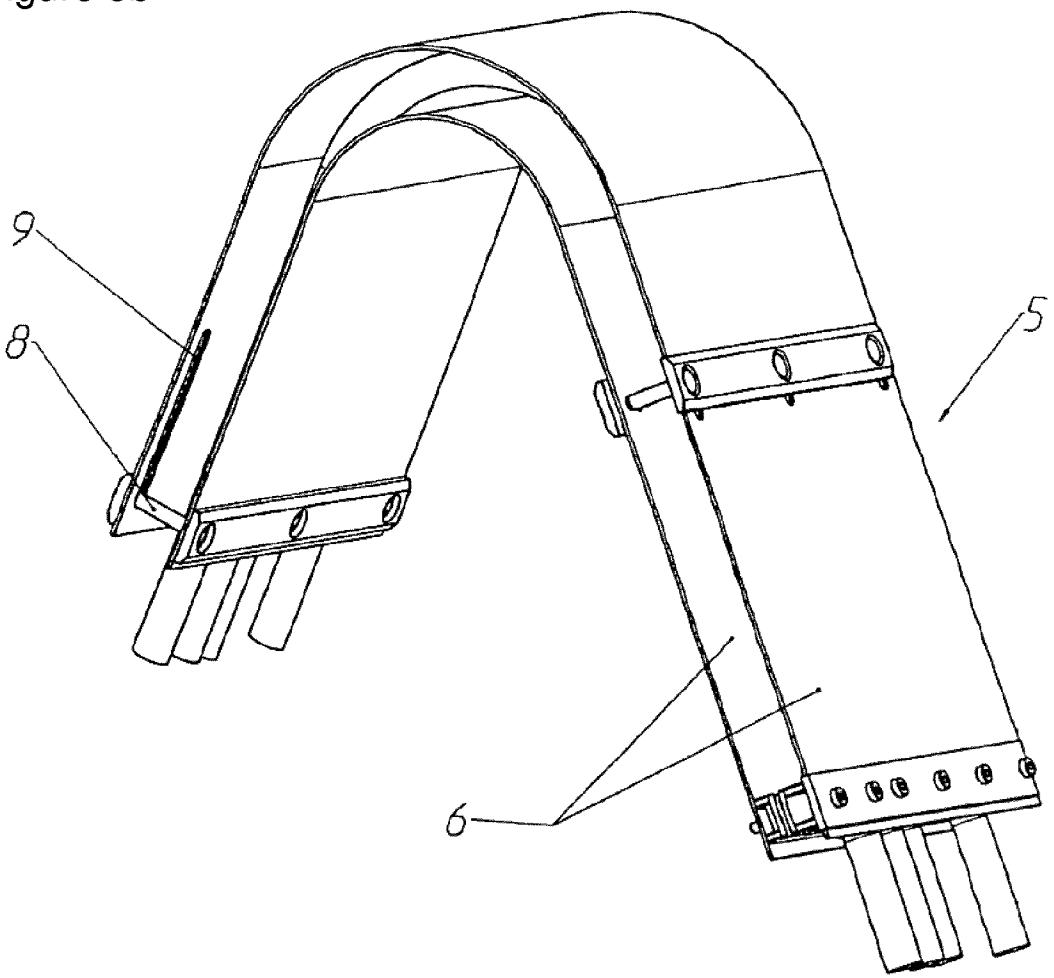
Figure 6A:
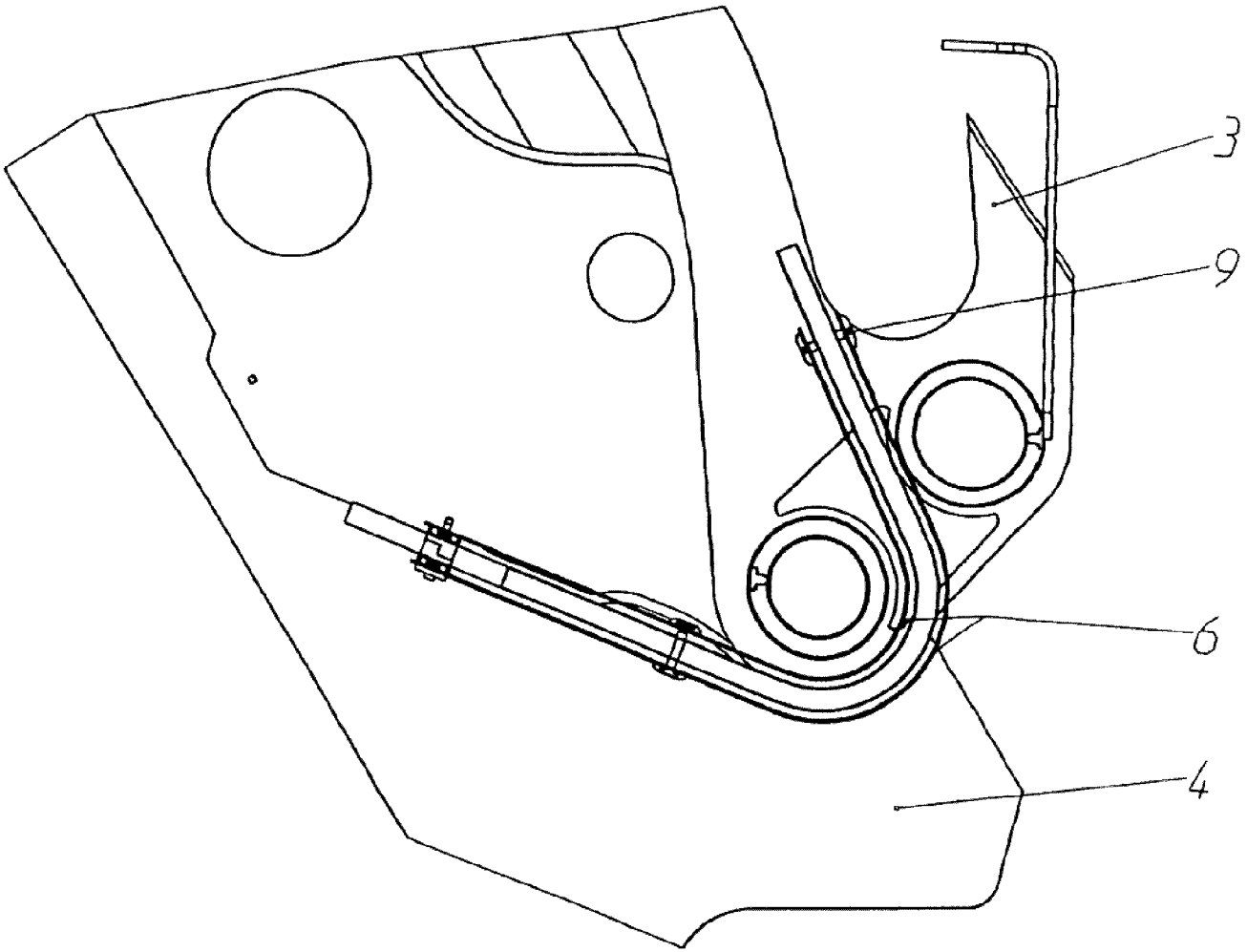
Figure 6B:
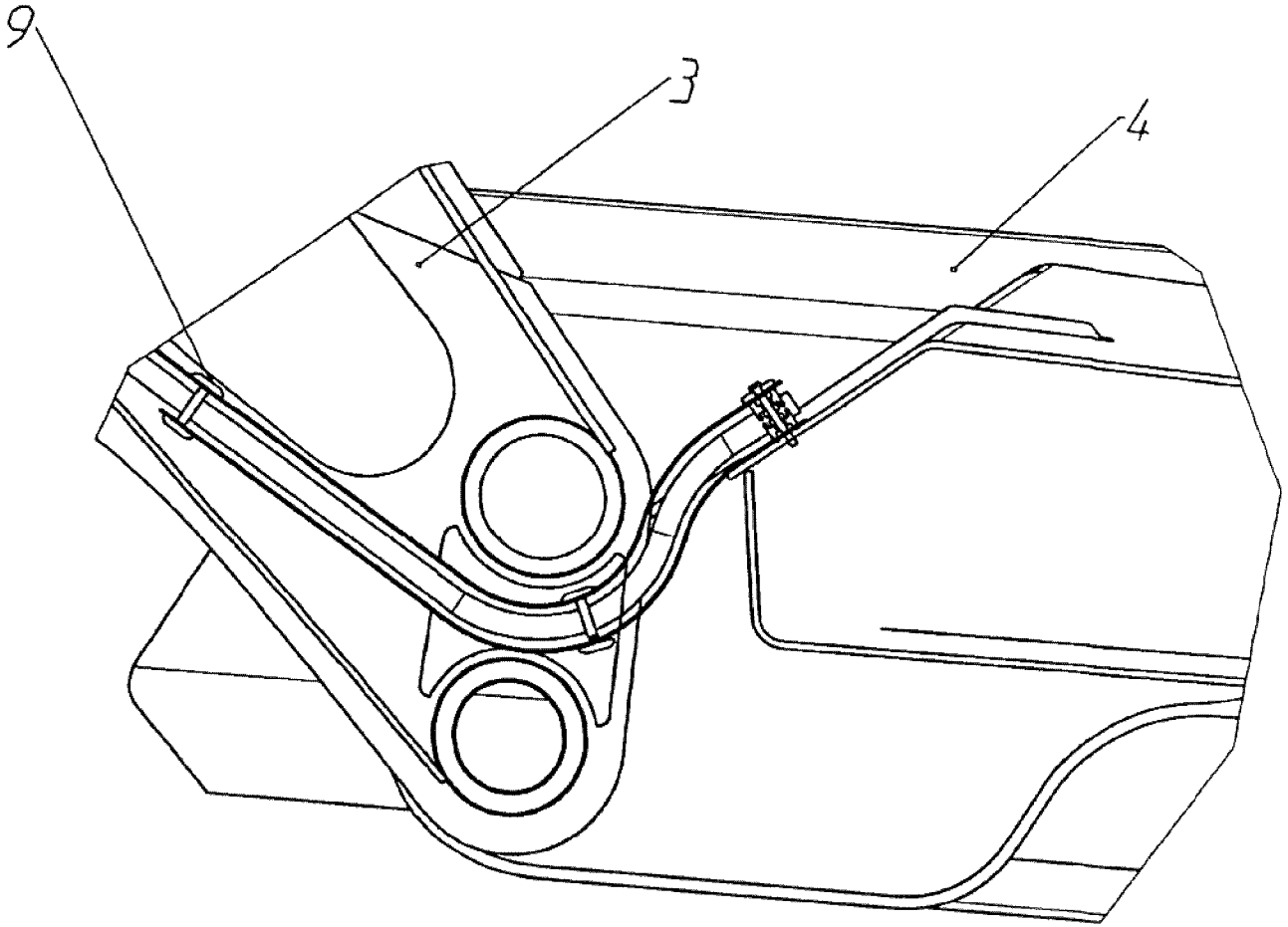
Figure 6C:
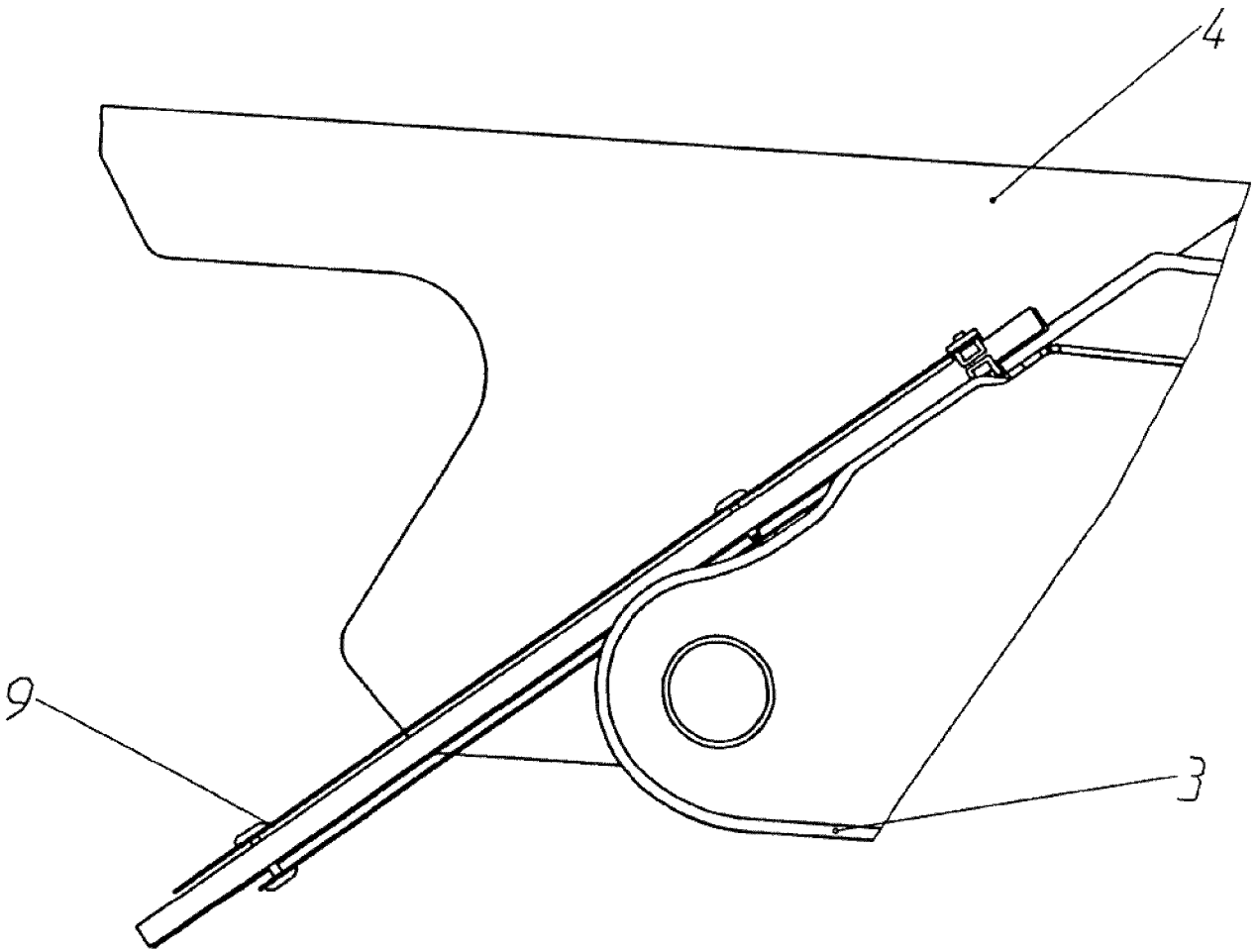

The slots 9 shown serve to accommodate the differing flexing radii. This function of the slots 9 can be seen particularly clearly if FIGS. 5*a* and 5*b* are compared.

In a manner similar to FIG. 3, FIGS. 6*a* to 6*c* show sectional views in the region of the joint for different working positions of the crane booms 3, 4.

In all of the figures, details which are familiar to the skilled person, such as piston cylinder units, have not been shown. In addition, the positions of the hydraulic hoses have only been shown in the relevant region of the joint.

The invention claimed is:

1. A mobile crane comprising:

at least two crane booms connected together by a joint such that an angular position with respect to each other is adjustable; and at least one hose passing between said crane booms, said hose being exposed in a region of said joint in at least one angular position of said at least two crane booms;

wherein at least one flexurally elastic sheet is connected with said at least one hose or covers the exposed region of said at least one hose, said at least one flexurally elastic sheet being configured to flex when the angular position of said at least two crane booms is changed, wherein said at least one flexurally elastic sheet is movable into or respectively out of one of said at least two crane booms upon a change in the angular position of said at least two crane booms.

2. A mobile crane according to claim 1, wherein said at least one fexurally elastic sheet is exactly one flexurally elastic sheet.

3. A mobile crane according to claim 1, wherein said at least one flexurally elastic sheet is imperforate.

4. A mobile crane according to claim 1, wherein said at least one flexurally elastic sheet is formed of one material of a group consisting of metal and plastic.

5. A mobile crane according to claim 1, wherein said at least one flexurally elastic sheet is two flexurally elastic sheets, wherein the at least one hose runs between said two flexurally elastic sheets.

6. A mobile crane according to claim 5, wherein said two flexurally elastic sheets are arranged to oppose each other so as to be separated by a smaller distance in a central region than at one of two end regions.

7. A mobile crane according to claim 1, further comprising at least one cuff for supporting said at least one hose, said cuff being arranged on said at least one flexurally elastic sheet.

8. A mobile crane according to claim 7, wherein said two flexurally elastic sheets are arranged to oppose each other so as to be separated by a smaller distance in a central region than at one of two end regions.

9. A mobile crane according to claim 1, wherein a thickness of said at least one flexurally elastic sheet is between 0.3 mm and 3 mm.

10. A mobile crane according to claim 9, wherein the thickness of the at least one flexurally elastic sheet is approximately 0.4 mm or is approximately 2 mm.

* * * * *